United States Patent [19]

McGugan et al.

[11] Patent Number: 4,785,678

[45] Date of Patent: Nov. 22, 1988

[54] SWING DRIVE MECHANISM

[75] Inventors: Ian J. McGugan, Newbury Park, Calif.; Robert L. Quinlan, Jr., Stow, Ohio

[73] Assignee: Gerber Products Company, Fremont, Mich.

[21] Appl. No.: 32,821

[22] Filed: Apr. 6, 1987

[51] Int. Cl.[4] ..... F16H 21/38; F16H 21/40; A63B 9/16

[52] U.S. Cl. ..... 74/42; 74/582; 185/40 C; 248/370; 272/86

[58] Field of Search ..... 5/108, 109; 74/25, 42, 74/581, 582; 185/40 C, 40 F, 40 L; 248/370; 272/85, 86

[56] References Cited

U.S. PATENT DOCUMENTS

| | | | |
|---|---|---|---|
| 459,555 | 9/1891 | Sutton | 185/40 C |
| 1,016,712 | 2/1912 | Schilling . | |
| 1,227,984 | 5/1917 | Vanderburgh | 5/109 |
| 1,458,049 | 6/1923 | Grieshaber | 272/86 |
| 2,544,298 | 3/1951 | Chodacki et al. | 5/109 |
| 2,564,547 | 8/1951 | Schrougham | 272/86 |
| 3,031,687 | 5/1962 | McNeil Stevens et al. | 5/109 |
| 3,146,985 | 9/1964 | Grudoski | 248/370 |
| 3,261,032 | 7/1966 | Reardon | 5/108 |
| 3,371,358 | 3/1968 | Shackel | 5/108 |
| 3,667,756 | 6/1972 | Barrett | 272/86 |
| 3,692,305 | 9/1972 | Allen | 272/86 |
| 3,842,450 | 10/1974 | Pad | 5/109 |
| 4,150,820 | 4/1979 | Bochmann | 272/86 |
| 4,211,401 | 7/1980 | Cunard | 272/86 |
| 4,448,410 | 5/1984 | Kosoff | 272/86 |
| 4,452,446 | 6/1984 | Saint | 272/86 |
| 4,491,317 | 1/1985 | Bansal | 272/86 |
| 4,616,824 | 10/1986 | Quinlan, Jr. et al. | 272/86 |

FOREIGN PATENT DOCUMENTS

| | | | |
|---|---|---|---|
| 499812 | 2/1954 | Canada . | |
| 1021502 | 11/1977 | Canada | 5/35 |
| 585945 | 12/1924 | France | 74/582 |
| 40780 | 3/1908 | Switzerland | 272/86 |
| 631026 | 10/1949 | United Kingdom . | |

OTHER PUBLICATIONS

M. D. M. Lam, "Motor Serves as its Own Tachmometer When Control Circuit Senses Back-EMF", *Electronic Design*, 4, Feb. 15, 1980.

*Primary Examiner*—Lawrence Staab
*Attorney, Agent, or Firm*—Townsend and Townsend

[57] ABSTRACT

A swinging apparatus such as a child's swinging play seat is driven by an extension spring linked between the suspension arm of the swing and a gear wheel which is coupled to a motor-driven drive shaft through meshed gears. In preferred arrangements, two gear wheels are used, arranged in coplanar configuration for reciprocal rotation in opposite directions, each driving an extension spring in alternating manner to swing the apparatus back and forth. In certain embodiments, pivot links are included to permit the extension springs to float when either the motorized drive shaft or the swing itself are stopped, and in certain further embodiments, guide pins are included to hold the springs in a bowed configuration. The mechanism is characterized by the lack of a tendency to jolt, and by the ability to start up and shut down smoothly at any point in the rotation cycle of the drive mechanism.

23 Claims, 4 Drawing Sheets

SWING DRIVE MECHANISM

BACKGROUND AND SUMMARY OF THE INVENTION

This invention relates to swinging devices, and finds particular utility in connection with children's devices, such as cradles and swings. In general, however, the invention is applicable to swinging devices of any description.

Power-driven swings are desirable in such applications as infant swings and cradles for keeping the infant amused or contented while leaving the parent free for other chores. Such mechanisms are not without their disadvantages, however, notably their susceptibility to jamming or slamming of parts resulting in unpleasant and sometimes dangerous jolts to the occupant. Jolts and jerky movements also occur during startup and shutdown, or when the cycle of the swing is interrupted to permit removal of the occupant. Frequently such mechanisms necessitate manual assistance for startup due to the mechanism's inability to transmit sufficient torque to overcome the gravitational load of the static mechanism. All this can be particularly troublesome when an infant is placed in the swing, since it may frighten the infant or cause injury.

It has now been discovered that much if not all of this difficulty is eliminated by a drive mechanism in which an extension spring joins the suspension arm of the swing to a gear wheel coupled to a rotating drive shaft of an electric motor through meshed gears. Circular rotation of the gear wheel is translated to linear oscillation of the force exerted on the extension spring which, combined with the spring's resilient character, provides a smooth swinging motion. The configurations of various embodiments of the invention allow the spring(s) to flex and bow permitting the interruption, start or stop of either the motor or swing in any position without damage to the motor or drive mechanism, followed by subsequent unassisted startup or smooth continuation of the swinging cycle when the motor is energized. The cycle may thus be frequently started or stopped by a timer or other automatic control mechanism, thereby further enhancing the application of the invention. Additionally, the configuration of various embodiments permits the use of a control circuit whereby the speed of the motor, under various loads, can be monitored and the electrical power input to the motor adjusted thereby maximizing efficiency and minimizing power consumption. The gear wheel, drive shaft speed, and any intermediate gears are sized and selected to conform to the period of the swing's oscillation.

Among the various embodiments of the invention, the gear wheel may be coupled to the drive shaft through either a worm gear or a spur gear on the drive shaft, either directly or through reduction gears. In further embodiments, two gear wheels are included, each linked to a separate extension spring, with the two springs applying pull forces to the swing in alternating manner and in opposite directions. The two gear wheels are either in mesh with each other or both in mesh with a worm gear on the drive shaft to produce rotation in opposite directions.

Further embodiments will be evident from the description which follows.

DETAILED DESCRIPTION OF THE INVENTION AND PREFERRED EMBODIMENTS

Figure 1:
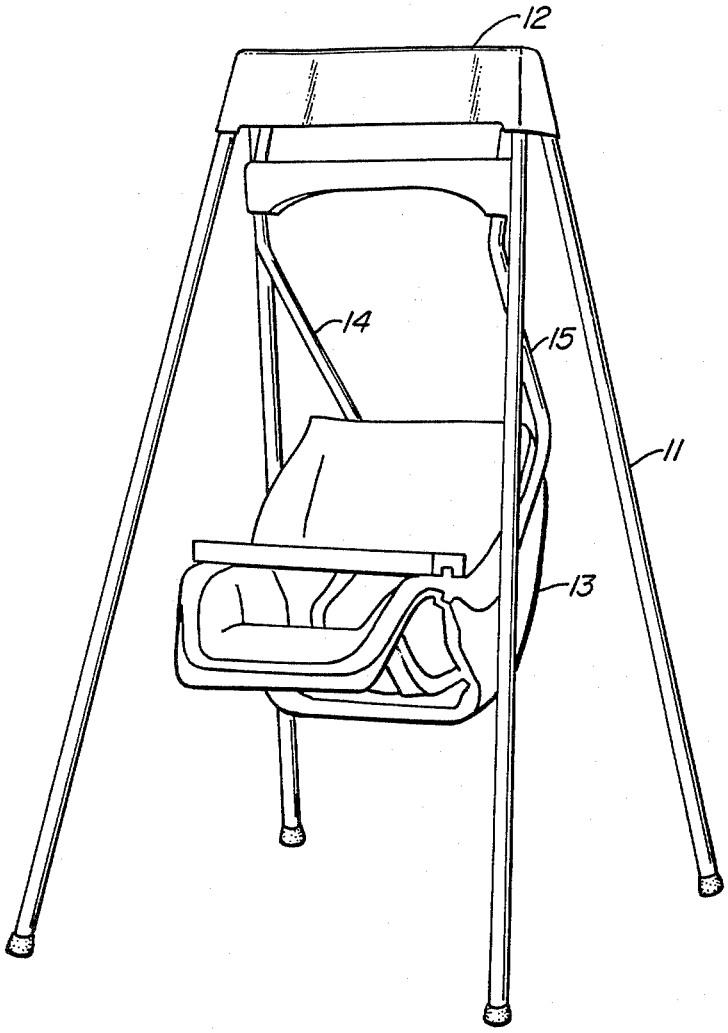
FIG. 1 is a perspective view of a motor-driven child's swing of the type capable of incorporating any of several embodiments of the present invention.

Component features of the swing shown in FIG. 1 are its support frame 11, the crossbeam 12 across the top of the support frame, the swing seat 13, and the swing suspension arms 14, 15. The latter hang from the interior of the crossbeam 12 in a swinging manner, permitting the suspension arms 14, 15 to swing relative to the frame 11. The crossbeam 12 also houses the drive mechanism which, as seen below, may assume any of various embodiments. The swing suspension arms 14, 15 may be of any character or construction suitable for supporting a swinging seat. They are preferably rigid such as, for example, lightweight metal tubing.

Figure 2:
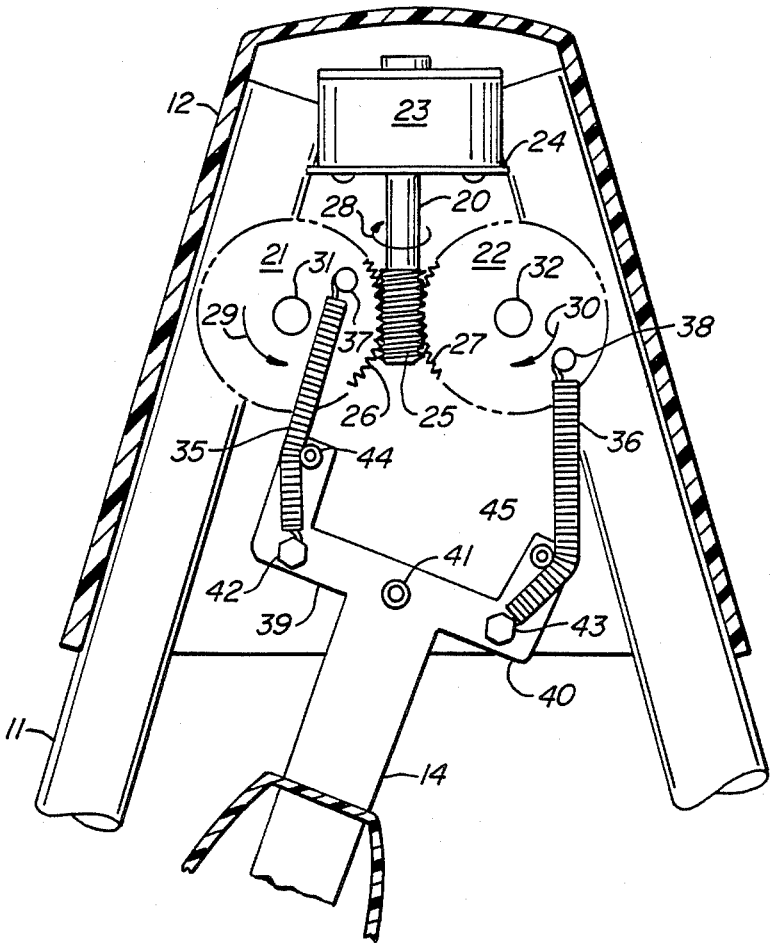
FIG. 2 is a cutaway view of the crossbeam of the support frame of the swing of FIG. 1, with a swing drive mechanism in accordance with one embodiment of the present invention.

The embodiment of FIG. 2 contains a drive shaft 20 and two gear wheels 21, 22 all positioned in substantially the same plane, which is vertical when the support frame is in the upright position which it occupies during use. The drive shaft 20 is driven by a motor 23 secured to a mount bracket 24 affixed to the interior of the crossbeam 12. A worm gear 25 on the drive shaft meshes with the teeth 26, 27 of the two gear wheels 21 22 simultaneously, at opposite sides, driving the two gear wheels in opposite directions. The teeth 26, 27 extend around the full circumference of the gear wheels 21, 22 respectively. Rotation of the drive shaft 20 in the direction shown by the arrow 28 thereby translates into continuous rotation of the two gear wheels 21, 22 in the directions shown by the respective arrows 29, 30. To provide the oscillating effect, the two gear wheels are of equal diameter, and their axles 31, 32 are along a horizontal line, perpendicular to the vertical drive shaft 20 and coplanar in the plane defined by the swing arc of the suspension arm 14.

A pair of extension springs 35, 36 join the gear wheels 21, 22, respectively, to the swing suspension arm 14 such that the springs alternately pull the suspension arm in opposite directions. The springs are linked to the gear wheels through drive pins 37, 38 on the flat faces of the gear wheels. These drive pins extend perpendicular to the plane of the gear wheels and are positioned at substantially equal distances from the respective gear wheel axles 31, 32. The positions of the drive pins 37, 38, with respect to each other are 180° out of phase. Rotation of the drive shaft 20 thus causes the drive pins 37, 38 to describe circles in a reciprocating manner with respect to each other.

In the embodiment shown, the upper end of the suspension arm 14 is generally T-shaped, with side arms 39, 40 extending in either direction transverse to the main portion of the arm, with the pivot axle 41 of the arm at the center. The lower ends 42, 43 of the extension springs are bolted to the side arms 39, 40, respectively. These bolts are preferably located substantially directly below the gear wheel axles 31, 32 respectively. Thus, with the motor 23 energized, one of the drive pins 37, 38 transmits an upward pull force through the extension spring 35 or 36 to which it is connected, to the respective side arm 39 or 40, while the other drive pin transmits a downward push force through its extension spring to the other side arm. As the gear wheels 21, 22 rotate, these forces are reversed back and forth in alternating manner causing the suspension arm 14 to swing back and forth around its pivot axle 41, thereby providing a swinging motion to the swing suspension arm. The spring connections at the drive pins 37, 38 are thus pivoting connections, whereas the connections of the other ends 42, 43 to the side arms 39, 40 of the suspension arm 14 may be fixed or pivoting. The extension springs may be stiff enough to both transmit a downward push force and an upward pull force while being sufficiently flexible to bend and permit continued swinging motion of the suspension arm 14 or the drive mechanism when one or the other is stopped.

Also in the embodiment shown are guide pins 44, 45 on the side arms 39, 40 respectively of the T-shaped upper end of the suspension arm 14. These guide pins are positioned so that each one at all points in the rotation of the gear wheels 21, 22 obstructs the direct line between the two ends of the respective extension springs 35, 36. The extension springs are thus passed around these guide pins, and thereby held in an outwardly bowed configuration as shown. This prevents the springs from jamming at any point during the swing of the suspension arm 14, and thereby avoids jolts or shocks to the swing occupant.

Figure 3:
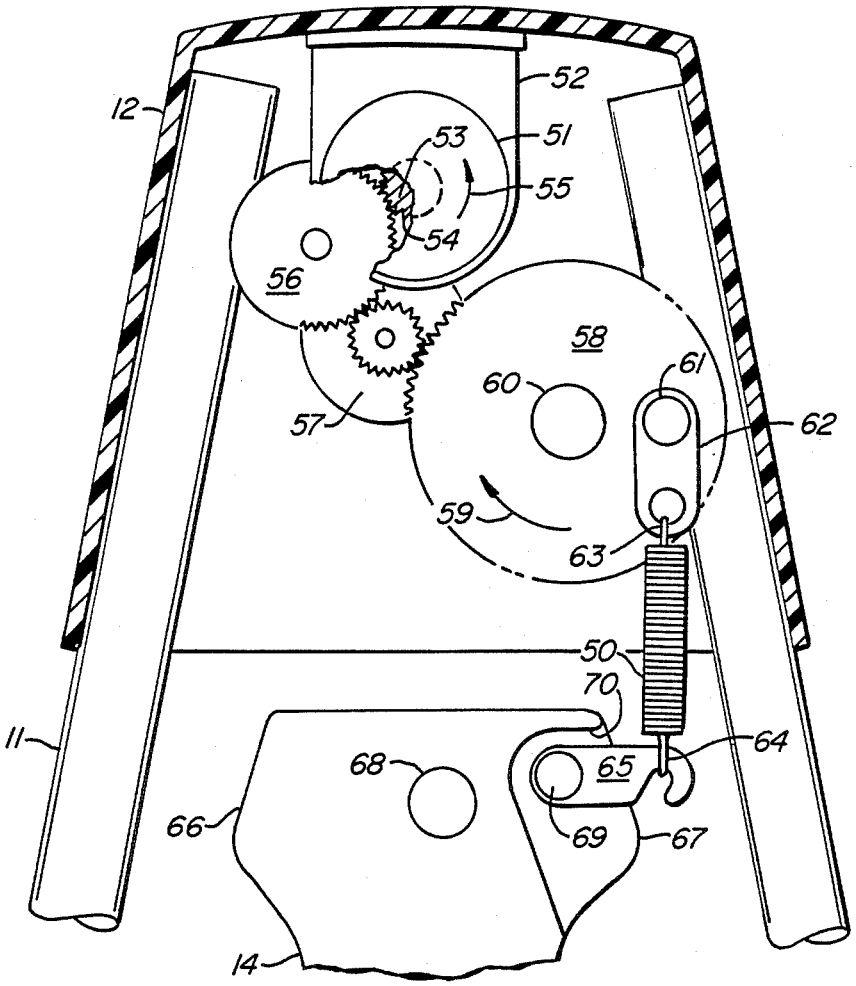
FIG. 3 is a view similar to FIG. 2 with the drive mechanism according to a second embodiment of the present invention.

Turning now to FIG. 3, a drive mechanism is shown which employs only one extension spring 50 and a set of gears made entirely of spur gears. The motor 51 in this embodiment is mounted horizontally on a vertical mount bracket 52 secured to the crossbeam 12. The drive shaft 53 extends horizontally and has a spur gear 54 affixed thereto. Rotation of the drive shaft in the direction shown by the arrow 55 is transmitted through a reduction gear 56 and a reversing gear 57 to a gear wheel 58 which rotates in the direction shown by the arrow 59 which exerts the pull force on the extension spring 50 to drive the swing. As before, the teeth on the drive shaft 53, reduction gear 56, reversing gear 57 and gear wheel 58 extend around the full circumference of each, providing continuous rotation as the motor 51 operates.

As in the FIG. 1 embodiment, the gear wheel 58 rotates about its axle 60, causing a drive pin 61 located off center on one side of the gear wheel 58 to describe a circle around the axle 60. A pivot link 62 pivotally attached to the drive pin 61 joins the latter to the upper end 63 of the extension spring 50, while the lower end 64 of the extension spring is joined to another pivot link 65 on the suspension arm 14. As in the FIG. 2 embodiment, the suspension arm 14 has a T-shaped upper end defined by two side arms 66, 67 with the pivot axle 68 of the suspension arm in between. The lower pivot link 65 is joined through a pivot connection 69 to one of the side arms 67.

The pivot connection 69 allows the pivot link 65 to pivot freely, thereby allowing the extension spring 50 to float when it is not under tension. Thus, in the embodiment shown the only force exerted by the extension spring 50 is a pull force on the upward half of its cycle around the gear wheel 58. This floating of the spring reduces drag in the swing when the motor is turned off, and facilitates both startups and shutdowns of the swinging motion at any point in the rotation of the gear wheel 58. A stop 70 in the path of the pivot link 65, however, prevents the pivot link 65 and extension spring 50 from coming into alignment. When the extension spring 50 is on the pull half of the cycle (and thereby under tension), the pivot link 65 is up against the stop 70 transmitting the force of the spring to the swing suspension arm 14, causing swinging to one side. During the other half of the cycle, the swing swings in the opposite direction by gravitational force.

Figure 4:
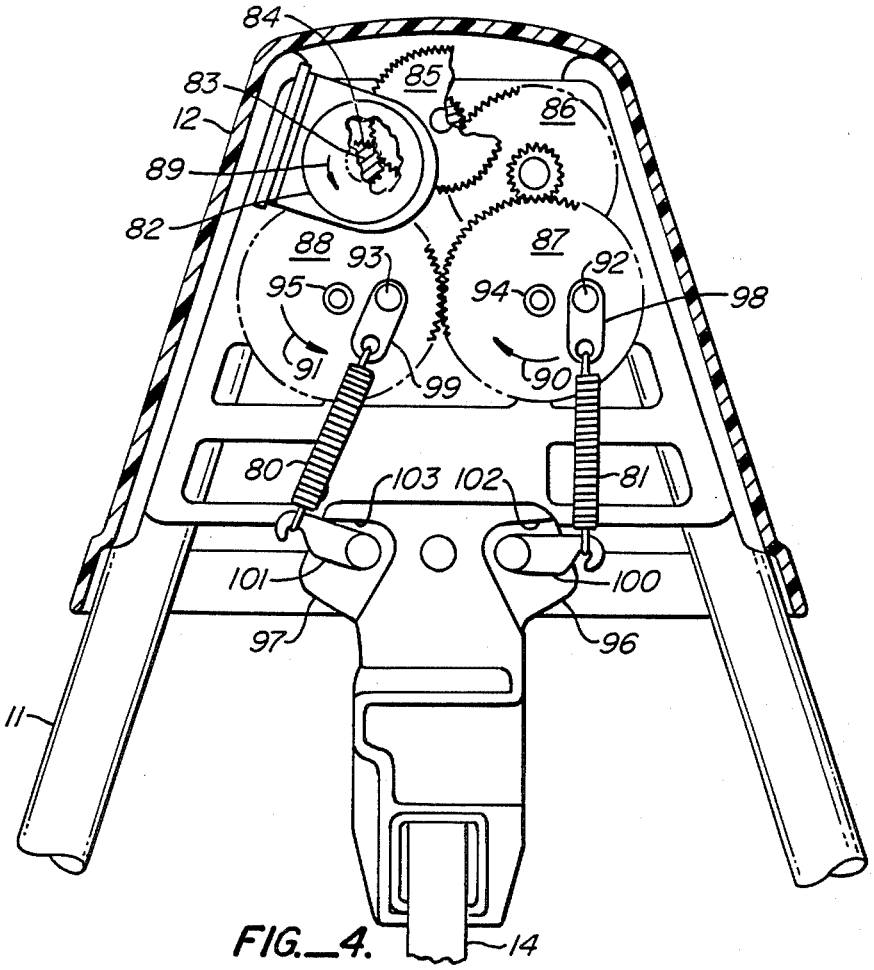
FIG. 4 is a view similar to FIGS. 2 and 3 with a drive mechanism according to a third embodiment of the present invention.

A still further embodiment is shown in FIG. 4, employing two extension springs 80, 81 and all spur gears. In this embodiment, the motor 82 is once again mounted with its drive shaft 83 horizontal and a spur gear 84 attached thereto. A pair of reduction gears 85, 86 transmits the drive shaft rotation to one gear wheel 87 driving one of the extension springs 81. A second gear wheel 88, coplanar with the first and of equal diameter and in mesh therewith, drives the other extension spring 80. Again, the teeth of all the rotating gears, including the spur gear 84 in the drive shaft, the first and second reduction gears 85, 86, and the two swing-driving gear wheels 87, 88, extend around the full circumference in each case, providing continuous rotation while the motor 82 is in operation. Accordingly, rotation of the drive shaft 83 in the direction shown by the arrow 89 results in rotation of the two swing-driving gear wheels 87, 88, in the directions of the arrows 90, 91, respectively. The gear wheels 87, 88, thereby rotate in opposite directions at the same rate.

Drive pins 92, 93 extend from the faces of each of the two gear wheels 87, 88, respectively, in the same manner and in accordance with the same principle as the drive pin 61 of the embodiment of FIG. 3. Here, however, the drive pins rotate in opposite directions. As in the FIG. 2 embodiment, the pins are located 180° out of phase, and due their placement offset from the respective gear wheel axles 94, 95 at equal distances therefrom, describe reciprocating circles of equal diameter. The reciprocating rotation of the gear wheels 87, 88 exerts upward forces on the two extension springs 81, 80 in alternating manner as in the FIG. 2 embodiment, which in turn transmit these forces to the suspension arm 14 through the side arms 96, 97 of the upper T-shaped end. Upper pivot links 98, 99 and lower pivot links 100, 101 connect the two springs to the gear wheels 87, 88 and the side arms 96, 97 of the suspension arm in the same manner as the corresponding pivot links shown in the FIG. 3 embodiment. Stops 102, 103 likewise function in a manner corresponding to that of the stop 70 of the FIG. 3 embodiment.

The motor shown in these embodiments may be any conventional motor capable of driving a rotatable drive shaft. This includes electric motors, both AC and DC, and both operating off standard household voltages and battery operated. The motor may also incorporate any conventional on/off activating means, including sound-activated electronic control.

In certain preferred embodiments, the motor is incorporated into a control circuit which uses the motor itself as a tachometer to provide precise speed control. The motor in this case will be a small DC motor from which a speed signal is obtained by feeding the motor a square wave and monitoring the back-EMF voltage during the "off" period.

Figure 5:
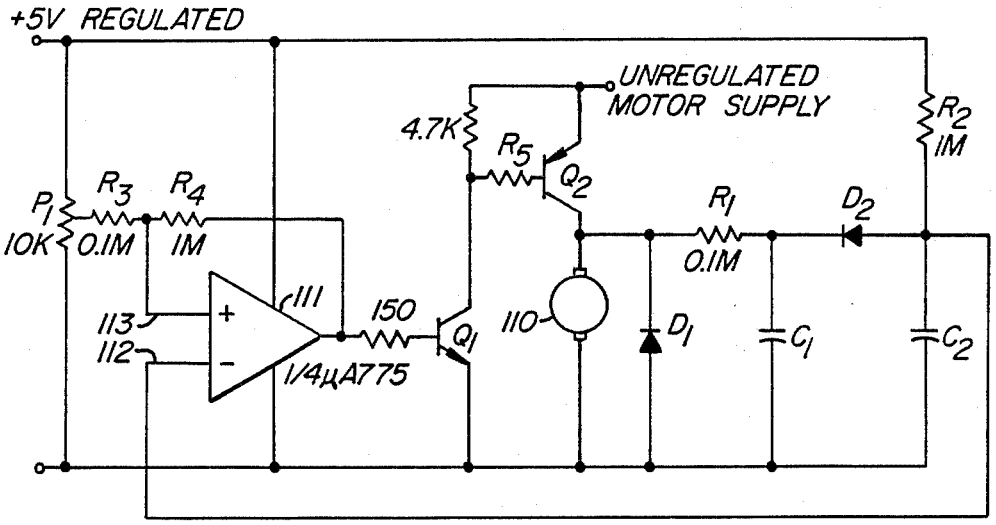
FIG. 5 is one example of a control circuit for a drive motor for use with the present invention.

An example of such a circuit is shown in FIG. 5. The small DC motor 110 develops a back-EMF directly proportional to its speed and partially dependent on the mechanical load to the extent that the drag generated by the springs varies with the speed. A comparator 111 is connected to the motor as a square-wave generator, controlling the buffer transistor $Q_1$ and the power transistor $Q_2$. These transistors and the current-limiting resistor $R_5$ are sized according to motor type and supply voltage. The motor is shunted by diode $D_1$ to avoid negative spikes. Motor noises are removed by the low-pass filter ($R_1$, $C_1$). Diode $D_2$ permits the one-way passage of the back-EMF, and transmits a representative speed signal 112. A reference signal 113 is set by a potentiometer $P_1$ (or any low-impedance voltage source).

The DC motor is fed with constant-duration pulses, the on-time being determined by the $R_2C_2$ time constant. When the shaft loading increases, more pulses are generated per unit time, the gap being determined by $R_1(C_1+C_2)$. Since the gap lowers the effective bias voltage, the supply voltage must be increased slightly to stay above the stall torque. The system is stabilized against overshoots in the pulse wave forms by increasing the value of $R_1$. The accuracy of the speed control can be increased by lowering the ratio $R_3/R_4$ or by placing an integrator in the loop.

The foregoing is offered primarily for purposes of illustration. It will be readily apparent to those skilled in the art that modifications, variations and substitutions of the various components shown and described can be made without departing from the spirit and scope of the invention.

What is claimed is:

1. A drive mechanism for a swing suspended by a suspension arm, comprising:

a motor-driven rotating drive shaft;

a gear wheel coupled to said drive shaft through meshed gears; and an extension spring joined at one end to said gear wheel and at the other end to said suspension arm, to resiliently lengthen and shorten as said suspension arm swings.

2. A drive mechanism in accordance with claim 1 in which said suspension arm has a T-shaped top end and said extension spring is linked to said suspension arm at one side arm of said T-shaped top end.

3. A drive mechanism in accordance with claim 1 further comprising means or holding said extension spring in a bowed configuration at all times.

4. A drive mechanism in accordance with claim 1 in which said extension spring is joined to said suspension arm through a pivotal linking member.

5. A drive mechanism in accordance with claim 4 further comprising a stop on said suspension arm preventing said linking member from pivoting into alignment with said extension spring.

6. A drive mechanism in accordance with claim 2 in which said gear wheel is vertical, is a spurtype gear wheel, and is coupled to said drive shaft through a spur gear on said drive shaft.

7. A drive mechanism in accordance with claim 2 in which said gear wheel is vertical, is a spurtype gear wheel, and is coupled to said drive shaft through a worm gear on said drive shaft.

8. A drive mechanism in accordance with claim 2 further comprising means for holding said extension spring in a bowed configuration.

9. A drive mechanism in accordance with claim 2 in which said gear wheel is vertical and is coupled to said drive shaft through a reduction gear.

10. A drive mechanism for a swing suspended by a suspension arm having a T-shaped top end, comprising:

a motor-driven rotating horizontal drive shaft with a spur gear affixed thereto;

a vertical gear wheel coupled to said spur gear through meshed gears;

an extension spring joined at one end to said vertical gear wheel, and at the other end to one side arm of said T-shaped top end of said suspension arm through a pivotal linking member; and a stop on said suspension arm preventing said linking member from pivoting into alignment with said extension spring.

11. A drive mechanism for a swing suspended by a suspension arm, comprising:

a motor-driven rotating drive shaft;

a first gear wheel coupled to said drive shaft through a first set of meshed gears;

a second gear wheel coupled to said drive shaft through a second set of meshed gears;

a first extension spring joined at one end to said first gear wheel and at the other end to said suspension arm; and a second extension spring joined at one end to said second gear wheel and at the other end to said suspension arm.

12. A drive mechanism in accordance with claim 11 in which said suspension arm has a T-shaped top end defined by first and second side arms; and said first and second extension springs are joined to said first and second side arms, respectively.

13. A drive mechanism in accordance with claim 11 in which said first and second sets of meshed gears are arranged to cause rotation of said first and second gear wheels in opposite directions.

14. A drive mechanism in accordance with claim 11 further comprising means for maintaining each of said first and second extension springs in a bowed configuration.

15. A drive mechanism in accordance with claim 11 in which said first and second gear wheels are each coupled directly to said drive shaft through a worm gear on said drive shaft.

16. A drive mechanism for a swing suspended by a suspension arm having a T-shaped top end defined by first and second side arms, comprising:

a motor-driven vertical rotating drive shaft with a worm gear affixed thereto;

a first gear wheel meshed with said worm gear;

a second gear wheel meshed with said worm gear;

a first extension spring joined at one end to said first gear wheel and at the other end to said first side arm;

a second extension spring joined at one end to said second gear wheel and at the other end to said second side arm; and means for maintaining said first and second extension springs each in a bowed configuration.

17. A drive mechanism in accordance with claim 11 in which said first and second gear wheels are spur-type gears in mesh directly with each other.

18. A drive mechanism in accordance with claim 11 in which said first and second sets of meshed gears each include a spur gear on said drive shaft.

19. A drive mechanism in accordance with claim 11 in which said first set of meshed gears is comprised of teeth on said drive shaft in mesh with teeth on said first gear wheel through a reduction gear, and said second set of meshed gears is comprised of teeth on said drive shaft in mesh with teeth on said second gear wheel through said first gear wheel and said reduction gear.

20. A drive mechanism in accordance with claim 11 in which said first gear wheel is coupled to said drive shaft through a first set of meshed gears: said second gear wheel is meshed directly with said first gear wheel; said suspension arm has a T-shaped top end defined by first and second side arms; and said first and second extension springs are joined to said first and second side arms, respectively.

21. A drive mechanism in accordance with claim 11 in which said first and second extension springs are joined to said suspension arm through first and second pivotal linking members, respectively.

22. A drive mechanism in accordance with claim 21 further comprising a stop preventing said first linking member from pivoting into alignment with said first extension spring, and a stop preventing said second linking member from pivoting into alignment with said second extension spring.

23. A drive mechanism for a swing suspended by a suspension arm, comprising:

a motor-driven horizontal rotating drive shaft having a spur gear affixed thereto;

a first gear wheel in mesh with said spur gear through a reduction gear;

a second gear wheel in mesh with said first gear wheel directly;

a first extension spring joined at one end to said first gear wheel, and at the other end to said suspension arm through a first pivotal linking member;

a second extension spring joined at one end to said second gear wheel, and at the other end to said suspension arm through a second pivotal linking member; and first and second stops preventing said first and second linking members respectively from pivoting into alignment with said first and second extension springs respectively.

* * * * *